US008851454B1

(12) United States Patent
Watts

(10) Patent No.: US 8,851,454 B1
(45) Date of Patent: Oct. 7, 2014

(54) UTILITY TOOL AND METHOD OF OPENING A DOOR

(75) Inventor: Glenn M. Watts, Manchester, CT (US)

(73) Assignee: Camur Tool, LLC, Manchester, CT (US)

( * ) Notice: Subject to any disclaimer, the term of this patent is extended or adjusted under 35 U.S.C. 154(b) by 165 days.

(21) Appl. No.: 13/297,488

(22) Filed: Nov. 16, 2011

Related U.S. Application Data

(60) Provisional application No. 61/414,926, filed on Nov. 18, 2010.

(51) Int. Cl.
*B66F 15/00* (2006.01)

(52) U.S. Cl.
USPC ..... 254/131.5; 254/25

(58) Field of Classification Search
USPC ..... 254/131.5, 131, 25, 19; 7/166, 168, 161
See application file for complete search history.

(56) References Cited

U.S. PATENT DOCUMENTS

| | | | | | |
|---|---|---|---|---|---|
| 439,336 | A | * | 10/1890 | Zitlow | 81/437 |
| 745,984 | A | * | 12/1903 | Alkire | 242/442 |
| 1,561,647 | A | | 3/1925 | Johnson | |
| 3,949,439 | A | | 4/1976 | Ardis | |
| 4,039,140 | A | * | 8/1977 | Pulliam | 254/25 |
| 4,744,272 | A | | 5/1988 | Leatherman | |
| 5,428,853 | A | | 7/1995 | Menke et al. | |
| RE35,424 | E | * | 1/1997 | Seals | 7/138 |
| 6,032,553 | A | * | 3/2000 | Brucart Puig et al. | 81/3.09 |
| 6,644,627 | B1 | * | 11/2003 | Forrester | 254/17 |
| 6,961,973 | B1 | * | 11/2005 | Smith | 7/139 |
| 8,113,094 | B1 | | 2/2012 | Brackbill | |
| 8,601,660 | B2 | * | 12/2013 | Duty | 29/235 |
| 2006/0075572 | A1 | * | 4/2006 | Young | 7/138 |
| 2009/0000039 | A1 | * | 1/2009 | St. John et al. | 7/138 |

OTHER PUBLICATIONS

Vigiano, J., FDNY, Techniques and Procedures, Forcible Entry Reference Guide, Dec. 2006, p. 34, available at firetactics.com/FORCIBLE%20ENTRY%20SOP%20FDNY.pdf.
Shove Knife: Tiny, yet mighty, p. 1, available at columbussupply.com/products/?productid=381.
Rice, F., Lockpicking 3 If it becomes necessary to pick a lock to enter a lab, the world's most effe, p. 2-3, skepticfiles.org/new/186doc.htm.
Ardis Tool Company, The Ardis Tool: Multi-Purpose Tool and Firefighting Weapon, Feb. 2011, p. 1-2, Danbury, CT, available at ardistool.com.
"Emergency Rescue Tools Assisting in Saving Lives for Firefighters, Police, Military, General Public" www.tugtool.com/index.htm Accessed Mar. 26, 2014.

(Continued)

*Primary Examiner* — Lee D Wilson
(74) *Attorney, Agent, or Firm* — UConn IP Law Clinic; Robert Smith; Joseph Romagnano

(57) ABSTRACT

Disclosed is a tool for opening an inward-swinging door system having a door, a door latch, a door jamb, and a door stop. The tool includes a substantially rigid lock opening element having a proximal portion and a curved distal portion proportioned to fit between the door and the door jamb and between the latch and the door stop. The curved distal portion is configured to be used as a fulcrum to leverage the lock opening element against the door stop thereby causing actuation of the door latch.

12 Claims, 6 Drawing Sheets

(56) References Cited

OTHER PUBLICATIONS

"Universal Locked Door Opener. (does not work on deadbolts)" by GlasEyes www.instructables.com/id/Universal-Locked-Door-Opener-does-not-work-on-de/ Accessed Mar. 26, 2014.
"Features" Section zootilitytools.com/ Accessed Mar. 26, 2014.
"Emergency Rescue Tools Assisting in Saving Lives for Firefighters, Police, Military, General Public" tugtool.com/index.htm Accessed Mar. 26, 2014.
"Universal Locked Door Opener. (does not work on deadbolts)" by GlasEyes instructables.com/id/Universal-Locked-Door-Opener-does-not-work-on-de/ Accessed Mar. 26, 2014.

* cited by examiner

UTILITY TOOL AND METHOD OF OPENING A DOOR

CROSS-REFERENCE TO RELATED APPLICATIONS

This application claims priority from the previously filed provisional application, U.S. Application No. 61/414,926 filed on Nov. 18, 2010, the entirety of which is incorporated by reference herein.

FIELD OF THE INVENTION

The present invention relates to a hand held tool for use by firefighters and similar personnel, particularly to open locked doors.

BACKGROUND OF THE INVENTION

When a firefighter is called to the scene of a fire alarm or other job-related call, it is advantageous for him to carry on his person the proper tools to respond to a wide range of problems. Emergency situations generally require the use of specialized tools which can cause damage to structures. In non-emergency situations, a tool is needed which can quickly open common doors without permanent damage to the structure. A fire alarm requires the firefighter to search all rooms in the building for signs of fire, trapped individuals, as well as searching for activated smoke/heat detectors or activated fire alarm pull stations. Other disciplines which require a tool that can open doors quickly and without damage are emergency medical services and police. Police activities can also require a relatively silent method of entry into a structure.

One way for firemen to obtain access is by way of a set of keys stored in a small locked box (so-called "Knox box") on the outside of the building. However, this box typically contains only a single set of keys and may or may not reflect the most recent door locks within the building. A single set of keys limits the speed with which locked rooms may be searched. In place of keys, a firefighter often uses a tool such as a "shove knife" to open the locked door. These tools are limited in the types of doors they can open and often require acute dexterity to operate the tool.

In addition, firefighters have need for other tools, such as Allen wrenches, openers for oxygen bottles, and the like. Since firefighters and other services require the use of heavy equipment, it would be convenient to have a single, small, compact, multi-purpose tool, which could be used to more easily open locked doors and perform the other functions often required.

SUMMARY OF THE INVENTION

An embodiment includes a tool for opening an inward-swinging door system. The term "inward-swinging door" as used herein refers to a door mounted in a doorway that opens towards an operator wishing to pass through the doorway. The door system can include a door, a door latch mechanism, a door jamb with striker plate and keeper, or other associated surface designed to engage the latch, and a door stop. A door stop, also sometimes referred to as a "slamming stile", can include a strip or projecting surface against which the door closes and is either attached to the door jamb or part of another surface. An example includes a double door (e.g., a "French" door) across an opening where one door forms part of the frame for the second door or there is a fixed center post between the doors. Where the term "door jamb" is used it is understood that a variety of surfaces and door frames perform a similar function and is not meant to limit the scope to one particular style of door or door construction. The tool comprises a substantially rigid latch displacement portion having a proximal element composed of a concave segmented curve and a distal convex arc element dimensioned and configured to fit between the door and the door jamb. The distal convex arc element is configured to be used as a fulcrum to leverage the latch displacement portion thereby causing displacement of the door latch.

In another embodiment, a tool for opening inward-swinging doors is disclosed. The door system can have a latch and a jamb, the jamb having a door stop and a face and the latch having a curved face on the side facing the door stop. The tool comprises a substantially rigid distal hook-shaped latch displacement portion sized to fit between the door and the face of the door jamb and in between the latch and the door stop. The first curve of the proximal segmented concave curve element can have a shape substantially complementary to and substantially conforming to the curved face of the latch, a blunt tip attached to the end of the hook-shaped portion, and a beveled head. In this embodiment, the hook-shaped latch displacement portion is configured to displace the latch mechanism of the door by leveraging the distal convex arc element of the tool against the door stop as a fulcrum.

In one embodiment, a method of opening an inward-swinging door system without causing structural damage thereto is also disclosed. The door system can include a door, a latch, a door jamb with striker plate and keeper, and a door stop. The method can include inserting a tool having a distal hook-shaped latch-displacement portion between the door and the door jamb, leveraging the tool against a door stop to cause movement of the end of the distal hook-shaped portion of the tool away from the door stop, thereby disengaging the latch with the distal hook-shaped latch displacement portion of the tool.

BRIEF DESCRIPTION OF THE FIGURES

The foregoing and other objects, features and advantages of the invention will be apparent from the following more particular description of illustrative embodiments of the invention, as illustrated in the accompanying drawings in which like reference characters refer to the same parts throughout the different views. The drawings are not necessarily to scale, emphasis instead being placed upon illustrating the principles of the invention. Those skilled in the art will understand that the devices and methods specifically described herein and illustrated in the accompanying drawings are non-limiting exemplary embodiments. The features illustrated or described in connection with one exemplary embodiment can be combined with the features of other embodiments. Such modifications and variations are intended to be included within the scope of the present invention.

DETAILED DESCRIPTION OF THE INVENTION

Figure 1:
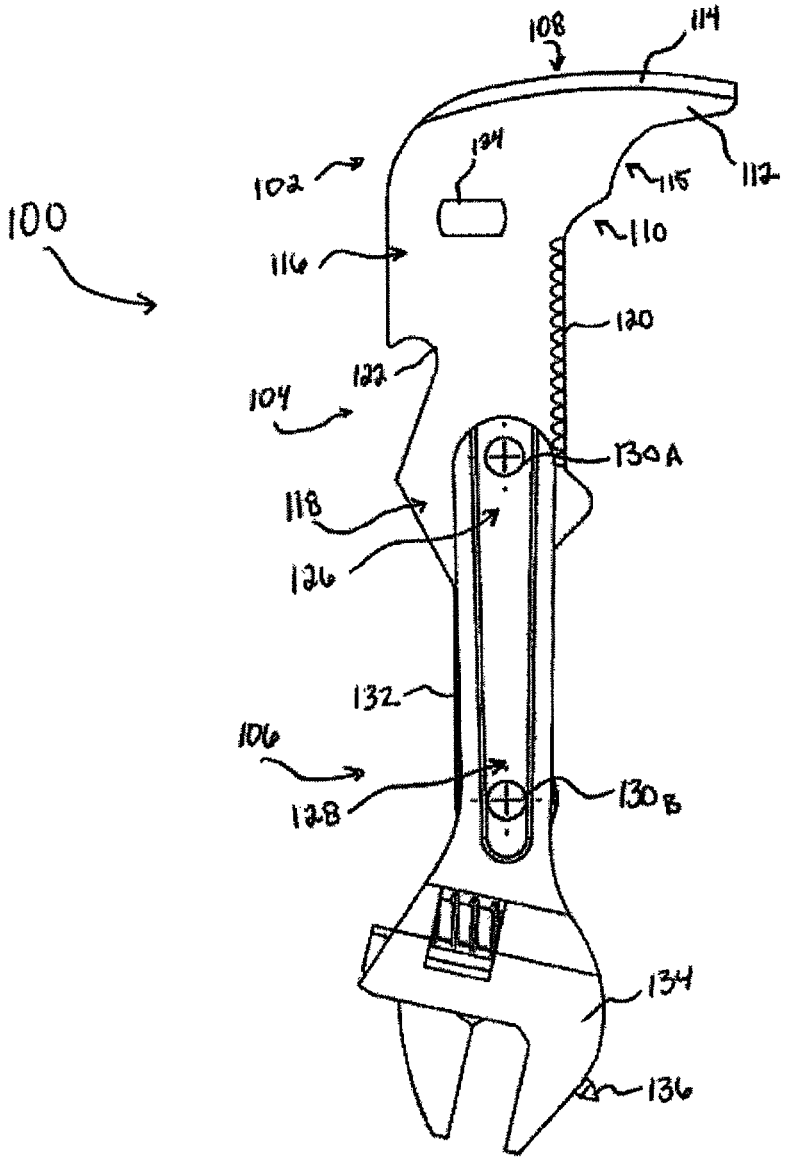
FIG. 1 shows a plane view of the tool.

Throughout the description and claims of this specification, the words "comprise" and "contain" and variations of them mean "including but not limited to", and they are not intended to (and do not) exclude other components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

Disclosed is a tool which can be used to displace the latch on many inward swinging doors. The tool can comprise a substantially rigid piece of steel or similar material with a distal hook-shaped latch displacement portion at one end which is configured to allow the user, such as a firefighter, to displace the latch. As exemplified in FIG. 5, the hook-shaped distal portion is composed of a convex arc dimensioned and configured to act as a fulcrum for a latch displacement portion of the tool that is contiguous across a blunt tip and having an interior concave curvature said interior concave curvature segmented into at least two discrete curves, the first curve substantially conforming to the face of a door latch. It can be important that the tool be substantially rigid and not bend or deform in use. In use, a distal end can be inserted between a door and door jamb and operated in a lever action with the exterior arc of the distal hook-shaped portion engaging the door stop while acting as the fulcrum to so that the first segment of the proximal interior segmented concave curve can contact the latch and then push, lift, pull, axially move or otherwise disengage and displace the latch from an associated engagement surface permitting the door to open. For example, since the tool is rigid, the body of the distal hook-shaped portion can be held in place to keep a latch disengaged from a hole in a latch plate. In addition, the semi-rigid tool and blunt tip can be used to walk the latch back out of the latch plate by using a side to side motion if the angled portion of the latch is not accessible from the space between the door and door jamb.

A firefighter must prepare for multiple scenarios once called to the scene of an incident. Since the firefighter cannot know ahead of time the true nature of the emergency, he must carry on his person multiple tools. Allen wrenches, a lock pick, and either Philips or flathead screwdrivers can be used to reset activated pull stations and give access to locked rooms and manipulate common screws. When at the scene of an automobile fire or accident, a firefighter must first disable the automobile's battery in order to ensure that the airbag does not deploy and cause injury to the automobile's occupants or the firefighter. In order to disable the battery, an adjustable wrench is used to unscrew the threaded terminals of different types and sizes of batteries. A seatbelt cutter is often utilized to free trapped persons involved in an automobile accident. Often wood, metal, and other obstructions need to be sawed or otherwise cut and removed from the working space—a feat often achieved by carrying a serrated blade, or saw. Medical oxygen tanks commonly used by firefighters and emergency medical services require a particular sized wrench to turn on or off. In one embodiment of the invention, the tool contains other devices to perform the functions described above. Additionally, the tool can be configured with a hole, ring, or clip to affix the tool to a cord or lanyard, keys, or hung for storage or from a pack or article of clothing.

Figure 2:
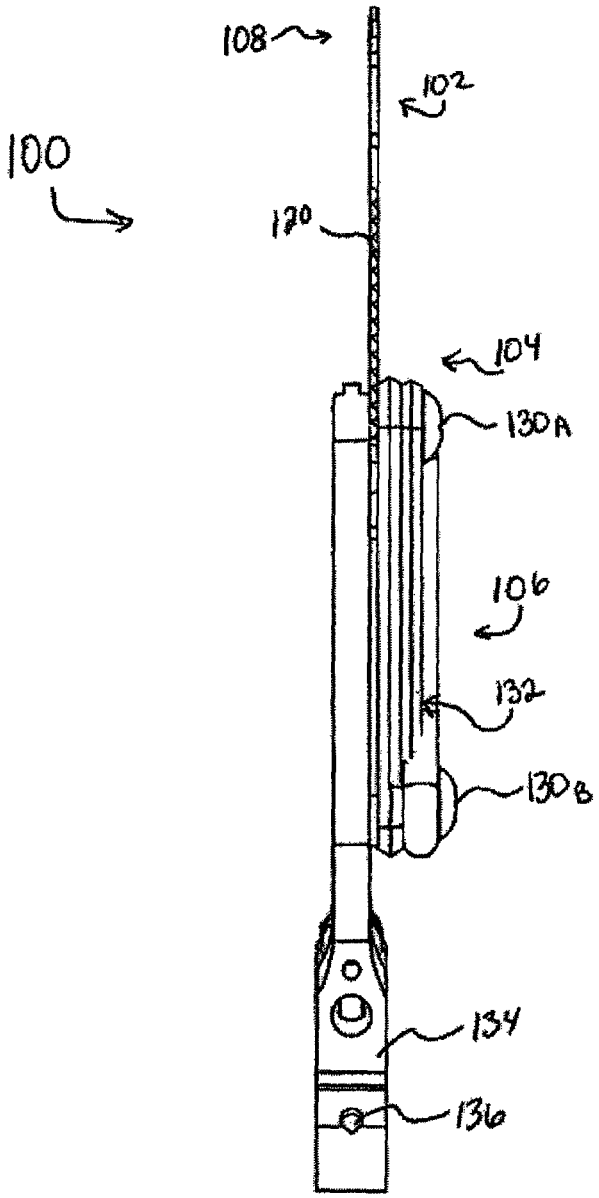
FIG. 2 shows a plane view of the tool.
Figure 3:
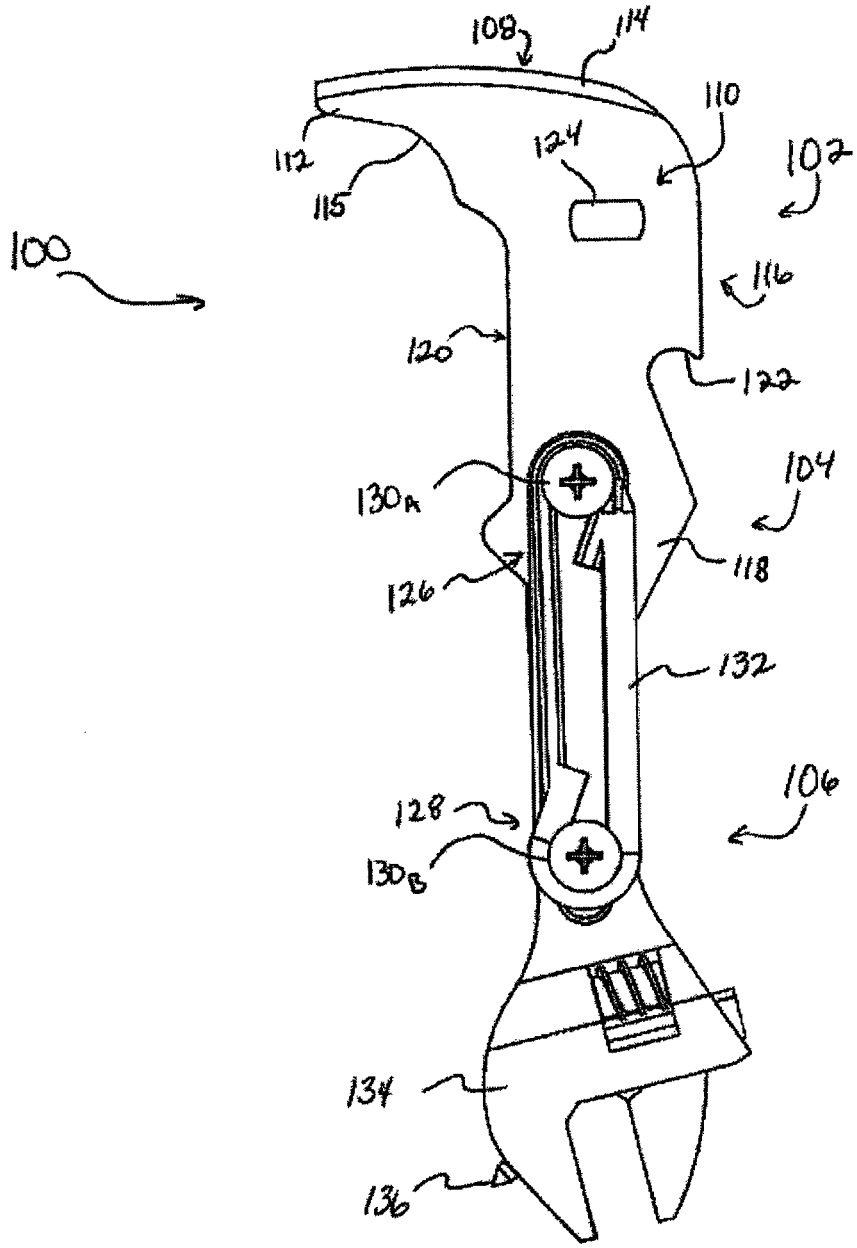
FIG. 3 shows a plane view of the tool.

FIGS. 1-3 show one embodiment of a tool designed to be carried by firefighters and other first responders. The tool 100 can be substantially rigid. The tool 100 can be formed from various substantially rigid, austenitic metals, such as iron, titanium, and various alloys such as stainless steel. The tool 100 can also be formed from substantially rigid plastics such as polyvinylchloride. The tool 100 is comprised of a distal hook-shaped latch displacement portion 102, a tang 104, and a handle 106.

In this embodiment, the distal hook-shaped latch displacement portion 102 is configured to allow the insertion of the tool between a door and a door jamb. The distal hook-shaped latch displacement portion 102 should be of a thickness that allows the tool to be used for most doors. In some embodiments the distal hook-shaped latch displacement portion 102 is between about 0.025 inches and about 0.25 inches in width, but persons having ordinary skill in the art will understand that the width of the distal hook-shaped latch displacement portion 102 should be such as to allow for insertion between common doors and door frames. Commonly, this width is about 0.05 inches. The distal hook-shaped latch displacement portion 102 can be substantially rigid such that portion 102 does not bend when a displacing force is applied and does not bend or deform when the proximal interior segmented concave curve shaped element 112 contacts hard surfaces, such as metal door latch. The distal hook-shaped latch displacement portion 102 can include a distal convex arced element 108 and a proximal portion 110. The distal convex arced element 108 and the segmented concave curve-shaped element 112 are the elements of the latch displacement portion 102 that contact a door frame or latch.

The distal hook-shaped latch displacement portion 102 can be inserted between a door and a jamb. The distal convex arc 108 is contiguous across a blunt tip with a segmented concave curve-shaped element 112. The segmented concave curve-shaped element 112 can be configured to be substantially complementary to and substantially conform to the contour of a curved face of a latch (not shown). The segmented concave curve-shaped element 112 may be used to move a latch out of a latch plate if the beveled portion of the curved face of the latch is exposed. In an embodiment, the segmented concave curve-shaped element 112 includes a blunt tip at one end and is configured to displace a door latching mechanism if the beveled portion of the latch is not exposed, by utilizing a side to side or twisting motion to "walk" the latch out of the keeper until the bevel is exposed. The segmented concave curve-shaped element 112 can be formed on the distal hook-shaped latch displacement portion 102 with distal convex arc 108, such that rotation of the tool 100 will cause the segmented concave curve-shaped element 112 to translate in the direction of the user.

Rotation of the tool 100 can be accomplished by inserting the tool 100 between the door and the frame (not shown) until the tool 100 contacts the door stop (not shown). Then, the curved surface of the distal convex arc 108 can be used as a fulcrum to rotate the tool 100, such that the interface of the distal convex arc 108 and the door stop (not shown) functions as the pivot point. Furthermore, the first curve, 115 of the segmented curved shaped element 112 can allow the tool 100 to pivot about a door latch (not shown) during displacement.

The distal convex arc 108 can be further configured to include a beveled edge 114. The beveled edge 114 can be configured to aid in the insertion of the tool into tight-fitting door and door frames.

The tang element 104 can be configured to provide support and rigidity to the latch displacement portion 102, and can be substantially rigid, as explained above. Tang 104 has a distal portion 116 and a proximal portion 118. The distal portion 116 of the tang 104 can be integrally formed with the proximal portion 110 of the hook-shaped latch displacement portion 102 or the tang 104 can be fastened to the proximal portion 110 of the hook-shaped latch displacement portion 102 by any suitable means such as welding. Tang 104 can have a width that is substantially similar to the proximal end of the hook-shaped latch displacement portion 102, and can be configured to also be disposed between door and a door jamb during operation or the tang 104 can be configured to have a different thickness than the hook-shaped latch displacement element 102. For instance, tang 104 can be thicker than the hook-shaped latch displacement portion 102 to provide extra rigidity to the tool 100 or alternatively be less thick to provide less rigidity to the tool 100. The tang 104 can also have a non-uniform thickness.

Accessories can be formed on the tang 104 to provide extra function to the tool 100. The accessories formed on the tang 104 generally can be cut-out from the tang 104 material. For instance, a serrated blade 120 can be formed integrally on the tang 104, a bottle opener 122 can be formed to allow the easy opening of liquid containers, and an oxygen bottle valve wrench 124 can also be formed integrally in the tang. Furthermore, a seatbelt cutter can be included and comprise a small slit with a sharpened curved terminus and can be used to cut a seat belt or other restraining device in case of need (not shown). The serrated blade 120 can be used to quickly cut wood, metal, plastic, or any other obstruction commonly encountered by a user. The oxygen bottle valve wrench 124 comprises a hole sized to accept a common oxygen tank valve control. The bottle opener 122 comprises a cutout portion of the tool 100 that is configured in such a way that a bottle cap can be removed from a bottle.

The tang 104 is connected to a first end 126 of the handle 106. The handle 106 can be configured to allow a displacing force to be applied to the tool 100 to leverage the tool against a door stop (not shown). The displacing force can be along a plane that will allow the distal convex arc element 108 to contact a door stop (not shown), thus causing the segmented concave curve-shaped element 112 to move along a path that causes the segmented concave curve-shaped element 112 to engage a door latch, thus causing the door latch to retract into the door.

The handle 106 can be formed of a substantially rigid material, as explained above, such as stainless steel or polyvinylchloride plastic. Furthermore, the handle 106 can be coated with a grip material, such as a rubber, to allow for easier usage. The tool 100 and handle 106 can be resistant to electrical current. In an embodiment, the handle 106 can be ergonomically shaped to allow easy gripping of the tool 100, for instance by having a shape that substantially conforms to a user's hand shape. In an embodiment, the handle 106 can have a thickness that is greater than that of the tang 104 and hook-shaped latch displacement portion 102. By having a handle 106 with greater thickness, extra rigidity and comfort can be supplied to the tool 100. Alternatively, the handle 106 can be the same thickness, width, and length as the rest of the tool 100.

In an embodiment, the handle 106, tang 104, and hook-shaped latch displacement portion 102 can be integrally formed from the same material and piece. In an embodiment where elements 102, 104, and 106 are integrally formed from the same piece, the elements 106, 104, and 102 are defined as being connected to one another. Alternatively, each element, the handle 106, tang 104, and hook-shaped latch displacement portion 102 can be removably attached, for instance by a fastener, as referenced by 130A, 130B. The tool 100 can be entirely foldable, with the handle 106 rotating along a plane relative to the tang 104 with the fastener 130A functioning as the pivot. In another embodiment, the handle 106 and tang 104 are welded together or formed from a single piece resulting in a connection that is non-rotatable. In this embodiment, the fastener 130A can still function as a fulcrum to fold accessories along a plane into the handle 106.

The handle 106 can also comprise at least one additional tool 132, 134, 136. In some embodiments, the handle 106 includes at least one foldable tool 132, such as an Allen wrench, a Phillips-head screwdriver, or a flat-head screwdriver. The at least one additional tool 132 can be foldable so as to have a storage position within the handle 106, and a utilization position wherein the at least one tool 132 is rotated to a position accessible for use. Alternatively, the at least one additional tool 134 can be non-rotatable, as is shown by non-limiting example in this embodiment with the incorporation of the adjustable wrench 134. The at least one additional tool 132 and 134 can be selectively foldable, meaning that none, some, or all of the additional tools can be rotatable with respect to the handle 106. If rotatable, the additional tools 132 and 134 can be rotatably attached to the handle with a fulcrum connector 130A, 130B. This can be achieved using any known rotatable connection device, such as a screw, nut and bolt, rivet, or bearing.

Figure 4:
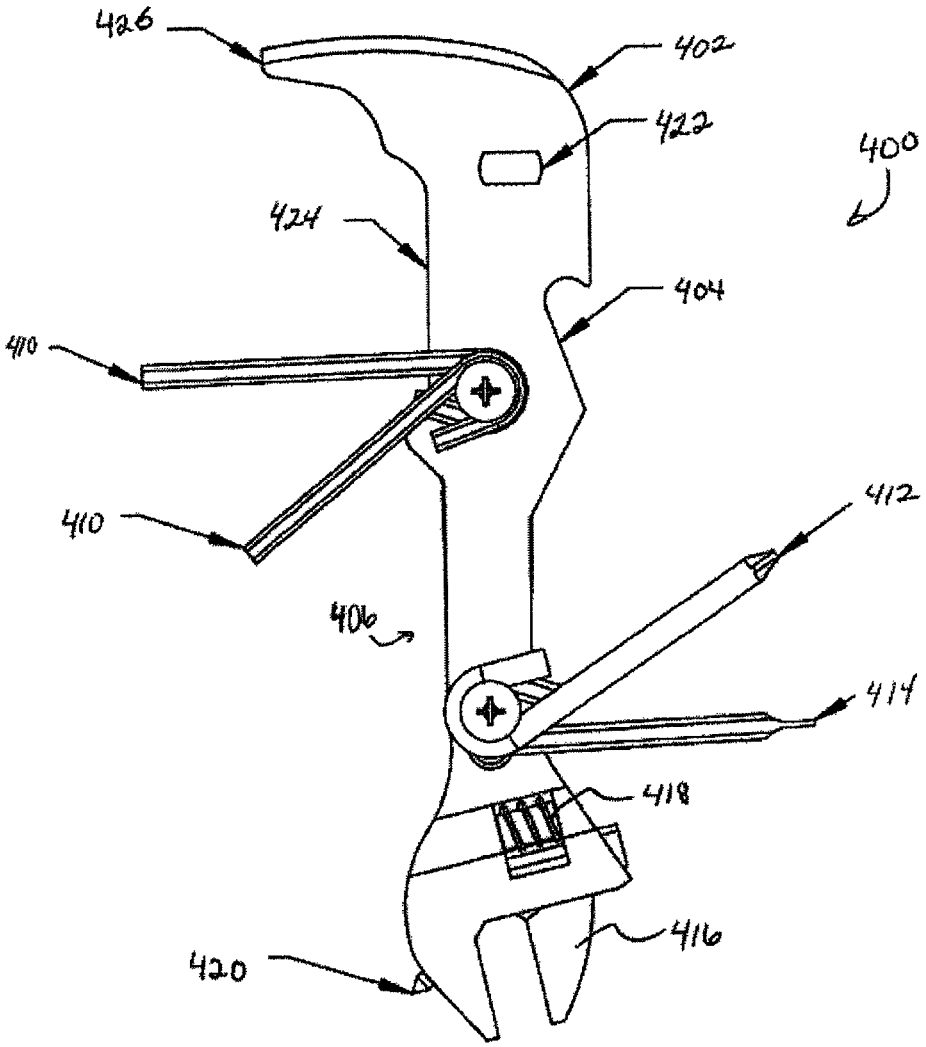
FIG. 4 shows a plane view of the tool with a plurality of additional tools so configured to allow use when folded out.

By way of example, FIG. 4 shows various additional tools, or accessories. Specifically, Allen wrenches 410 and screw drivers 412, 414 can be folded into the handle 406 for storage and folded out for use. An adjustable wrench 416 can be disposed on the handle 406 and can be opened and closed to accommodate various sizes and types of bolts and nuts. The adjustable wrench 416 is adjusted by the wrench adjuster 418, which can comprise a travelling spanner jaw that translates inside a keyway when the wrench adjuster 418 is actuated by a user.

The adjustable wrench 416 can include a glass-breaking point 420. In some embodiments, the glass-breaking point 420 can be formed or disposed on the body of the wrench 416 as is shown in FIG. 4. Alternatively, in some embodiments the glass-breaking point 420 can be formed or disposed on the end of the travelling spanner jaw such that when the adjustable wrench 416 is in an open position the glass-breaking point 420 is disposed within the keyway and when the adjustable wrench 416 is in the closed position the glass-breaking point 420 is disposed outside of the keyway allowing for its utilization to break glass.

This embodiment may also include cut-out accessories, "tools", such as an oxygen valve wrench 422 and a knife edge 424. The embodiment can include a latch displacing portion 402 that is hook-shaped to facilitate the displacement of a door latch. The latch displacement portion 402 can include a blunt end 426 that has a depth sized to allow the latch displacement portion 402 to fit in between a door stop and a door latch. The depth of this blunt end 426 can be sized according to the standard gap between a door latch and a door stop.

Figure 5:
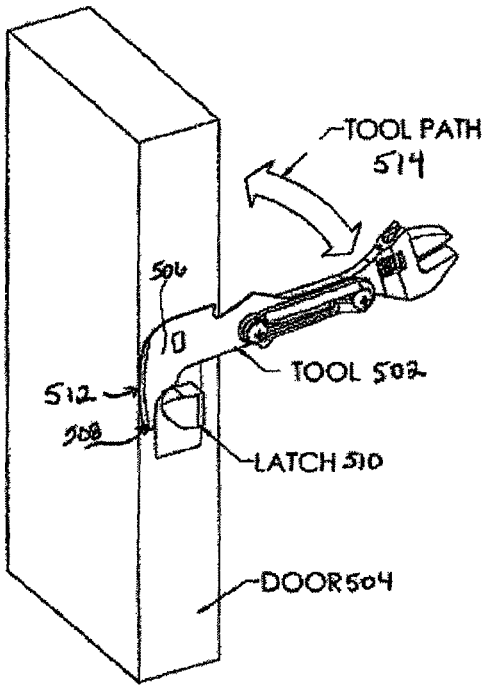
FIG. 5 shows the tool in use opening a door.
Figure 6:
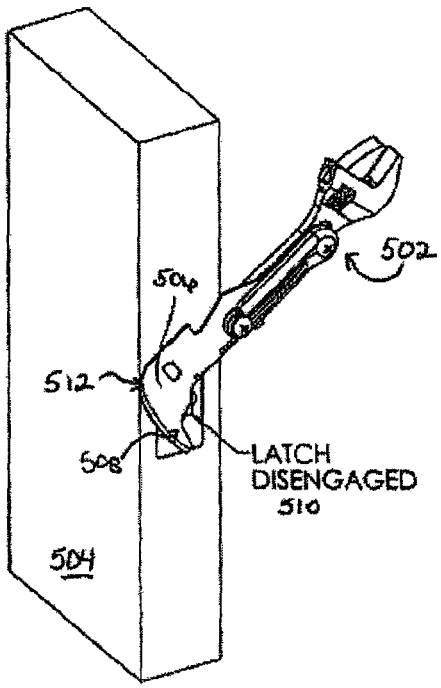
FIG. 6 shows the tool in use opening a door.

FIGS. 5 and 6 show a tool 502 in operation opening a door 504. The tool 502 is used by inserting the hook-shaped latch displacement portion of the tool 506 between the door 504 and the face of a jamb (not shown). The segmented concave curve shaped element 508 can have a depth that permits it to fit between the curved face of the latch 510 and the door stop (not shown). After the hook-shaped latch displacement portion 506 is inserted, the segmented concave curved shaped element 508 can be positioned against the latch 510. A displacing force can be applied to the tool 502 to leverage the distal convex arc element 512 against the door stop (not shown), thus using the interface of the distal convex arc element 512 and the door stop (not shown) as a fulcrum. As can be seen in FIG. 5, the segmented concave curve shaped element 508 of the tool 502 can be formed to substantially conform to the curved face of a latch 510. This shape will allow the upward motion of the tool 502 in relation to the door 504, as indicated by arrow 514, to displace the latch 510. When the tool 502 moves upward along arrow 514, the latch 510 is pushed into the door 504. The door is now free to be opened. The tool can be used either above the latch as shown or below the latch with the tool orientation opposite of that shown. In the latter instance, the tool 502 would be rotated downward to displace latch 510.

Figure 7:
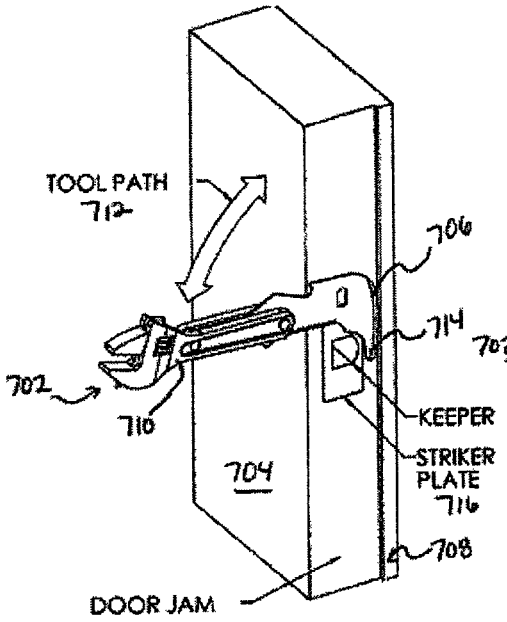
FIG. 7 shows the tool in use opening a door.
Figure 8:
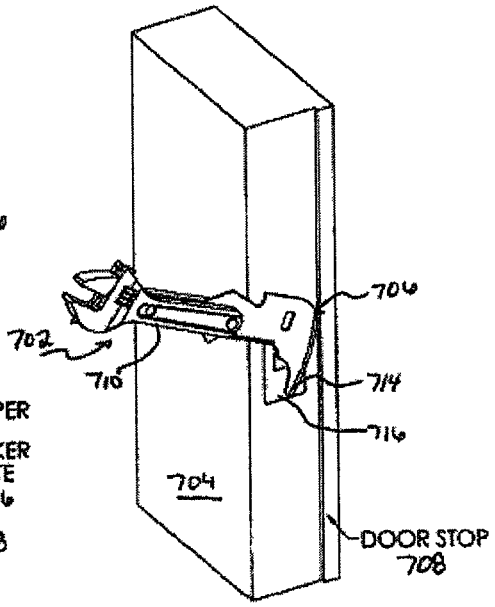
FIG. 8 shows the tool in use opening a door.

The configuration of the tool with respect to the elements of a door frame, or jamb, and striker plate are shown in FIGS. 7 and 8. In FIG. 7, the positioning of the tool 702 is shown as inserted between a door frame 704 and a door (not shown), with the distal convex arc element 706 of the tool 702 resting against the door stop 708. By placing the tool in this manner, the distal convex arc element 706 can be used as a fulcrum for the tool 702 against the door stop 708. Segmented concave curve shaped element 714 can be sized to conveniently fit between the curved face of the latch (not shown) and the door stop 708. By moving the handle 710 upward along the path outlined by arrow 712, the segmented concave curve shaped element 714 is moved away from the door stop, displacing the latch (not shown). In FIG. 8, the segmented concave curve shaped element 714 is shown after having been rotated upward so as to cause the latch to displace from the opening in the striker plate 716.

FIGS. 5-8 demonstrate a method of opening a door without causing substantial structural damage to the frame or door. By inserting a tool 502, 702 into the gap between the door 504 and the door jamb 704, a segmented concave curve shaped element 508, 714 can be inserted between the latch 510 and the door stop 708 as described above. The tool 502, 702 can then be leveraged against the door stop to cause movement of the segmented concave curve shaped element 508, 714 away from door stop 708 thereby displacing the latch 510.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A tool for displacing a door latch of a locked door comprising:

a semi-rigid member less than about 0.25 inches thick with a bottom proximal end forming a handle and a hook-shaped top distal portion, said hook-shaped distal portion composed of a convex arc dimensioned and configured to act as a fulcrum for a latch displacement portion of the tool that is contiguous across a blunt tip and having an interior concave curvature said interior concave curvature segmented into at least two discrete curves, the first segment having a concave curve adjacent to said blunt tip and shaped to substantially conform to the curvilinear face of said door latch.

2. The tool of claim 1, wherein the convex arc of the hook-shaped distal portion is dimensioned and configured to rotate the tool against an associated door stop such that movement of the tool handle causes movement of the interior concave curvature away from the door stop to displace a door latch from a latch engagement surface.

3. The tool of claim 1, wherein the convex arc of the hook-shaped distal portion is beveled.

4. The tool of claim 1, wherein the tool handle has a portion thereof dimensioned and configured into a plurality of accessory tools.

5. The tool of claim 4, wherein the accessory tools are integrally formed as part of the head, handle, or interior of the tool body.

6. The tool of claim 4, wherein the accessory tools are selected from a group consisting of: an oxygen bottle opener, a cutting surface, or a bottle opener.

7. The tool of claim 1, wherein the handle is provided with a non-slip or non-conductive material.

8. The tool of claim 1, wherein the handle is of a thickness different from that of the hook-shaped distal portion.

9. The tool of claim 1, wherein the handle further comprises at least one additional tool.

10. The tool of claim 9, wherein the at least one additional tool is selected from a group consisting of: an adjustable wrench, an Allen wrench, a Phillips-head screwdriver, a flat-head screwdriver, a glass-breaker, or a cutting tool.

11. The tool of claim 9, wherein the at least one additional tool is configured to be stowed into the handle and folded out to be accessible for use.

12. The tool of claim 9, wherein the at least one additional tool is attached to the handle in a removable fashion.

* * * * *